US006141807A

United States Patent [19]

Tapper

[11] Patent Number: 6,141,807

[45] Date of Patent: Nov. 7, 2000

[54] ADJUSTABLE HEIGHT PILLOW AND RELATED FURNITURE

[76] Inventor: David Tapper, P.O. Box 900, Woodstock, N.Y. 12498

[21] Appl. No.: 09/326,387

[22] Filed: Jun. 4, 1999

[51] Int. Cl.[7] ..... A47C 20/02

[52] U.S. Cl. ..... 5/653; 5/640; 5/657; 5/652

[58] Field of Search ..... 5/640, 653, 657, 5/652; 297/250.1, 219.1, 255, 256.11, 256.1

[56] References Cited

U.S. PATENT DOCUMENTS

| | | | |
|---|---|---|---|
| 3,775,785 | 12/1973 | Mittendorf | 5/341 |
| 4,312,088 | 1/1982 | Webb | 5/11 X |
| 4,349,925 | 9/1982 | Macomber | 5/431 |
| 4,649,582 | 3/1987 | Cho | 5/640 |
| 4,670,924 | 6/1987 | Spector | 5/640 |
| 4,763,369 | 8/1988 | Spector | 5/640 |
| 4,959,880 | 10/1990 | Tesch | 5/434 |
| 5,070,558 | 12/1991 | Fenley | 5/640 X |
| 5,134,740 | 8/1992 | Summer | 5/653 X |
| 5,528,784 | 6/1996 | Painter | 5/640 |
| 5,584,086 | 12/1996 | Vanwinkle et al. | 5/644 |
| 5,718,010 | 2/1998 | Beier | 5/640 X |
| 5,732,427 | 3/1998 | Parnham | 5/640 |

OTHER PUBLICATIONS

Cranz, Galen PhD, The Chair, Rethinking Cultures, Body and Design, ©1998, WW Norton & Co., NY, NY. P. 101–104 IsBno. 393–04655–9.

*Primary Examiner*—Terry Lee Melius
*Assistant Examiner*—Fredrick Conley
*Attorney, Agent, or Firm*—Alfred M. Walker

[57] ABSTRACT

An adjustable height pillow that offers a user the option of many heights and degrees of firmness, and which encourages proper posture in various meditation and other sitting positions. The pillow is comfortable for the user in either meditation or normal sitting environments including workstations. The pillow includes at least one encircling belt either within a concealing sleeve or exposed as a dramatic design statement. The belt can cinch and constrict the medial portion of the pillow by reducing its circumference, thereby causing the filler material to move from the medial portion to respective upper and lower portions of the pillow thus increasing the height of said pillow.

19 Claims, 8 Drawing Sheets

ADJUSTABLE HEIGHT PILLOW AND RELATED FURNITURE

FIELD OF THE INVENTION

The present invention is an adjustable pillow that promotes proper posture and comfort for both conventional seating and for sitting in meditation. The invention has been trade named "SeiFu™" which can be interpreted in some situations as meaning "right cushion" in Japanese.

BACKGROUND OF THE INVENTION

Traditionally in meditation, pillows are round and low, roughly 16 inches in diameter and 3 to 6 inches in height. They are called zafus and are usually filled with a natural material called kapok, but sometimes they are filled with buckwheat hulls. The zafu is designed to support meditators in a position called either Burmese or lotus, depending on the placement of the legs. In either of these positions the legs are crossed in front and the mediator's bottom rests on the edge of the cushion. The cushions frequently grow soft with use and make sitting uncomfortable.

Other supports for meditators are called seiza benches. They generally are made of wood and have a seat roughly 17 inches wide resting on a support on either side some seven inches high. In the seiza position, a person sits kneeling with his or her bottom supported on the bench and with her/his knees resting on the ground.

Due to limiting physical characteristics, which include arthritis, aging, injuries, various illnesses and general stiffness, it is often difficult for a person to assume a comfortable position with existing pillows and benches. The difficulty becomes especially acute during the long and frequent periods of meditation often required in meditation practice centers.

Therefore, there is a need for a pillow which can be adjusted to the physical needs of the user, enabling mediators to sit more comfortably and longer. It is these needs which the present invention solves.

Adjustable pillows are known, but until now adjustable pillows which have been patented are increased in height or width by adding a wedge shaped insert to the interior of the pillow such as described in U.S. Pat. No. 3,775,785 of Mittendorf, wherein wedge shaped portions are added to vary the shape of the pillow. A height adjustable pillow is described in U.S. Pat. No. 5,732,427 of Parnham which includes a pillow which is cut from a block of material that includes a removable insert which can be taken out to decrease the height of the pillow. However such a pillow requires the cumbersome removal of the insert for a decrease in height and does not offer a gradual adjustment.

In addition, U.S. Pat. No. 5,528,784 of Painter discloses an adjustable neck pillow which includes many pillow sections with lateral protrusions which are connected to a central base portion. The height of the pillow is adjusted by adding or removing parallel pillow portions from on top or beneath other portions. In Painter, '784 however, the height of the pillow can only be adjusted by adding or removing one of the laterally extending pillow portions.

Furthermore, U.S. Pat. No. 4,349,925 of Macomber discloses a pillow with a design configuration for a neck holding section. Finally in U.S. Pat. No. 4,959,880 of Tesch, a cushion including cushioning material, such as down, feathers, fibers, balls of fibers, or foam particles or the like, includes a hollow interior with an insert bag which can be filled with the filler materials. Thus the height or the size of the pillow can be adjusted by adding or removing the insert.

However, in Tesch '880 adjusting the height of the pillow requires the actually opening the pillow and removing or adding the insert abruptly adjusting the height of the pillow in a non-gradual manner.

The present adjustable cushion offers many ergonomic advantages. Galen Cranz, Ph.D., discusses the ideal standards for ergonomic seating in her book "THE CHAIR, Rethinking Culture, Body and Design." Ms. Cranz is professor of architecture at the University of California at Berkeley, specializing in the sociology of architecture, and she is a certified teacher of the Alexander Technique for structural realignment of the body. She writes:

"After reviewing all the havoc sitting in chairs wreaks upon the body, it becomes less surprising that this cultural practice could impede overall morphological development . . . . "

"ERGONOMIC CONSENSUS"

"How does the science of ergonomics help us overcome the deleterious effects of chair sitting? Some ergonomic recommendations are straightforward and self-evident, and following them would actually minimize, but never completely eliminate, the damage caused by chair sitting. Many chairs fail to meet at least some of these basic standards. These guidelines are termed "performance guidelines," meaning that the criteria are meant to enhance behavior, and that the measures in inches are not ends in themselves. How many criteria from this simple checklist does your workaday chair violate?"

"CHAIR SEATS SHOULD NOT BE TOO HIGH"

"For conventional right angle seating, the Swedish chair researcher Bengt Akerblom argued as early as 1948 for a lower sear height in order to accommodate the shorter half of the population. Today, the standard seat height for an ordinary task chair with a flat seat is 18 inches from the floor, but that is a distortion for at least half of the population. In other words, it suits some sort of mythical "average" body, which turns out to be a tall male body. So, for all children, most women, and a healthy percentage of men, chairs are too high."

"If a chair is too high, it cuts under the knee, pressing the thigh muscles up from below on the edge of the seat. This forces the muscle tissue to take on a load bearing function for which it was not designed. If you are sitting now, do you feel pressure under your thighs? If so, your veins and arteries cannot circulate blood properly. An easy way to tell if your seat is at the right height is that your heals should reach the ground. Your entire foot, including the heels, should rest securely on the floor or other underpinning. If the heals are pulled up, your thighs are probably being compressed against the front edge of the seat."

"CHAIRS CAN ALSO BE TOO LOW"

"If your knees are higher than your hip sockets, that jams your hip joint, and worse, reverses the natural forward curve of your lower back, stressing the discs. The height issue is further complicated by one of the ideas for seating reform, namely, that one's knees should be lower than one's hips in order to preserve the natural curve in the lower back. In this case, one can "walk" the sit bones out to the very edge of the chair and perch there. Higher is better until the sitter approaches a half-sitting/half standing position,"

"For now, our focus is on traditional chairs. Seventeen inches might be a safe compromise, but multiple sizes or adjustable heights are preferable. Like Goldilocks, you want a chair that is not too high, not too low, but just right."

"THE FRONT RAIL OF THE SEAT SHOULD BE CURVED DOWNWARD"

"The reason for curving the front rail of the chair is to eliminate the sharp edge that might cut into flesh under the knee, called the popliteal region. All ergonomicists agree on this simple rule, but it is violated in chairmaking fairly often. . . . "

"WEIGHT SHOULD BE DISTRIBUTED THROUGH BONES, NOT FLESH"

"When seated, you should be able to feel your sit bones on the seat. That's another way of saying that flesh is not supposed to be loadbearing; bones are. This means that both sitter and designer should avoid deep padding for sitting. An overpadded chair forces the sit bones to rock in the padding rather than make contact with a stable surface, thereby forcing the flesh in the butt and thighs to bear weight. Ergonomics researchers say the padding should be "just right," but they don't explain exactly what number of inches they would recommend at what density and for what weight. I prefer one-quarter-inch padding and find one-half-inch padding okay, but any more than that seems to create instability for the sit bones."

"You should be able to feel the sit bones doing their job-carrying about 60 percent of your weight. (When properly seated, the other 40% is transferred down to the heels, which is why they need to be set comfortably on the floor.) To find your balance of weight internally, sit on bare wood. Rock on your sit bones from front to back about ¼–½ inch. Remember that feeling when buying a chair."

"SPACE BETWEEN SEAT AND BACK IS PREFERABLE TO CONTINUOUS SUPPORT"

"Many ergonomicists agree that there should be some space between the seat and the lower edge of the back of the chair. Without that space, the sacrum and the pelvis are pushed forward. That eliminates the natural curve in the lower spine and makes the spine unstable. If there is no space for our butts, we lapse into C-shaped posture. This is true even in lounge chairs if they don't offer an adequately articulated joint between seat and back for our hips and pelvis."

"Unfortunately, these sensible recommendations, backed up by scientific studies, are ignored by many, many designers. If consumers were to refuse to buy or use chairs that ignored even these criteria, chair design would be reformed remarkably, and there would likely be an enormous benefit for the public health." ©1998, Galen Cranz, Ph.D., W W. Norton and Co., New York, N.Y. pg. 101–104, ISBN No. 0-393-04655-9.

It is these deficiencies in ergonomic chair and cushion structures that the present invention seeks to alleviate.

OBJECTS OF THE INVENTION

It is therefore the object of the present invention to provide an adjustable pillow that can be gradually adjusted to change both height, firmness and to some degree width.

It is also an object of the present invention to enable a person in a meditative sitting position to adjust the height and firmness of the pillow to achieve a comfortable and recommended lumbar curve for the sake of a healthy back. At the same time, the pillow provides a broad and comfortable base for sitting in meditation position when the pillow is placed on the ground or on a properly designed stool.

It is further the object of the present invention to provide a comfortable, posture enhancing pillow and chair combination for persons sitting in an office or study environment. And, of course, the same benefits would apply to people using the pillow and chair combination for dining or other table based activity. It is also an object of the present invention to provide a height adjustable pillow that can be adjusted gradually according to the needs of the user.

It is also the object of the present invention to provide an adjustable pillow that is different and superior to the advantages of prior pillows.

It is also an object of the present invention to provide an adjustable cushion for children that will be fun to play with and which will provide ergonomic advantages to the youngsters. The young person's pillow will be adjusted in scale to the weight and height of children under the age of fifteen.

It is yet another object of the present invention to improve upon the disadvantages of the prior art.

SUMMARY OF THE INVENTION

In keeping with the objects and others, which may become apparent, the present invention includes an adjustable pillow of a generally cylindrical shape, which in use can raise the sitter from two inches off the ground to fourteen inches off the ground. The pillow can be adjusted in firmness and height by cinching one or more encircling belts around the medial portion of the pillow thus increasing the density of the pillow at its midsection, thereby elevating the top portion of the pillow and pushing the bottom portion away from the center.

The pillow is preferably a cylinder of roughly nine to fourteen inches in height and includes one or more, usually two, encircling belts that run inside of belt sleeves.

It should be noted that the pillow can be slid backwards on its base so that the sitter can find a perch on the resulting slope that is as low as two inches off the ground. In fact, the sitter can sit anywhere on the resulting slope.

The pillow is filled with some form of bead type material, preferably buckwheat hulls, but artificial fillers such as plastic beads and foam rubber etc. could work. The pillow allows the user who chooses to sit in lotus, Burmese or Seiza positions to adjust the height and firmness of the pillow to accommodate his/her bodily needs and the style of sitting he/she has chosen. The pillow can alternatively be placed so that its axial portion is parallel to the ground so that the user can sit on it in this position. This sideways or axial position provides a broad expanse for the seat and is thus very comfortable. The straps in this horizontal, cylindrical position can control the cushion's degree of height and firmness. Since the cinching of the belt causes compression of the pillow in its medial mid portion, making the pillow longer, harder and more cylindrical, there are a variety of comfort adjustments which can be made by the user prior to sitting upon the pillow.

Furthermore, since buckwheat hulls tend to collapse with age, the ability to cinch this pillow keeps it firm and useful through a longer life cycle than that of conventional buckwheat pillows.

In addition, this pillow can be sized to make it applicable to the sitting needs of children, who spend much of their time on the floor, playing, listening to music, television watching and even studying. Its very adjustability will appeal to young users who customarily sprawl in all manners of positions, and its ergonomic potential might help youngsters grow into better postures.

An auxiliary non-adjustable cylindrical pillow approximately 20 inches long and about seven inches wide, which also uses buckwheat hulls as filler, is available for the mediator to use. It can be placed under the mediator's knees with the purpose of relieving pressure on the knees. This long pillow can also be used as a prop under the leg of a person sitting in Burmese. It is called a mini-zabuton.

While the adjustable pillow is primarily designed for use while meditating, its unique features will help people in sedentary office jobs and in any other standard sitting activity. The pillow creates an angle that encourages people to sit with a medically recommended lumbar curve. In standard seated positions, an auxiliary frame supports the cushion. The frame has 3 or 4 legs supporting a horizontal base upon which the pillow is placed in an upright position. This feature is especially useful for someone who spends long hours at a computer.

The SeiFu™, the present invention, can be made firmer or softer, taller or lower, narrower or wider thus helping the sitter. These adjustments can be made gradually thus the present invention offers a wide range of pillow sizes and contours to the user. In practice, in meditation halls, many mediators change between using a pillow and a bench frequently for the sake of comfort. Thus, a single device that serves the function of both the zafu pillow and of the seiza bench becomes very useful. The present invention serves both these purposes. The adjustability of this cushion can also help non-mediators. They can use it on the floor as a flexible hassock or they can use the adjustable cushion on a simple stool like chair, which is described in this application. The stool brings the SeiFu™ to normal seating height for use at a dining table or a computer. In essence, the SeiFu™ stool offers a secondary use of the SeiFu™ for purchasers.

It is further noted that the usual position for an office worker in a chair is counter productive for a healthy back and can exaggerate or create back problems. When the SeiFu™ is used in conjunction with the proper furniture base, it provides the cushion angle most recommended to promote a proper lumbar curve in the sitter. The improved lumbar angle also helps mediators who use the cushion on the floor.

Another use of the present invention is in the creation of a line of pillows for children below the age of fifteen. These are smaller pillows, being provided with different trade names, including "Mush Cush™", "Tush Cush™", and "Push Cush™". These pillows are generally three to eight inches in height. These smaller adjustable cushions enable kids to sit in a variety of ways while watching television, or playing games. The construction of them is simpler, and they are stuffed with easily available items. The same ergonomic advantages described herein apply to the use of the cushion by children.

DESCRIPTION OF THE DRAWINGS

The present invention can best be understood in conjunction with accompanying drawings in which.

DETAILED DESCRIPTION OF THE PRESENT INVENTION

Figure 4:
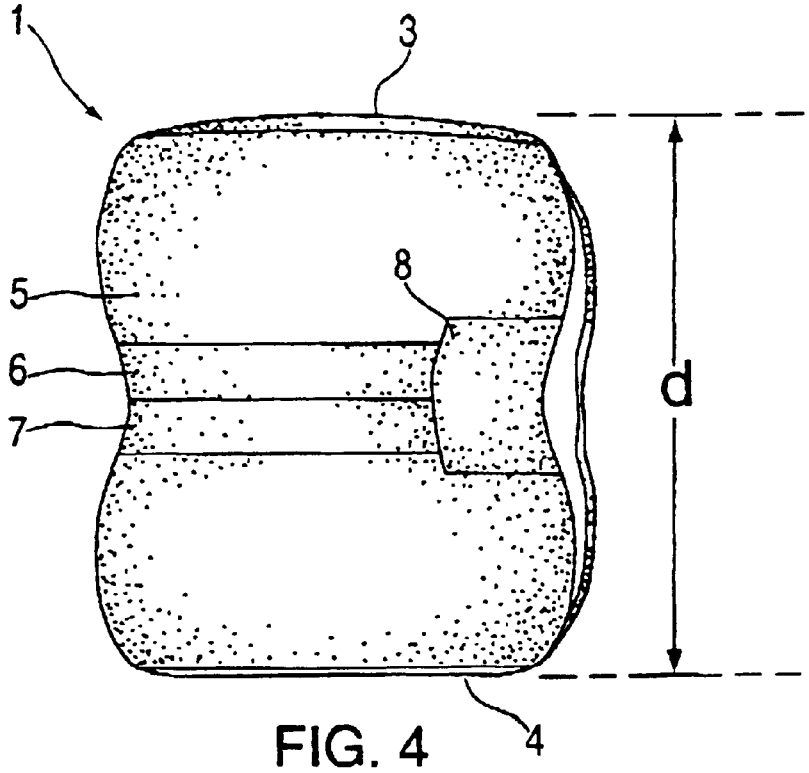
FIG. 4 is a side elevation of the pillow as in FIG. 1 shown in a constricted hour glass configuration, with a constriction of the medial portion.
Figure 5:
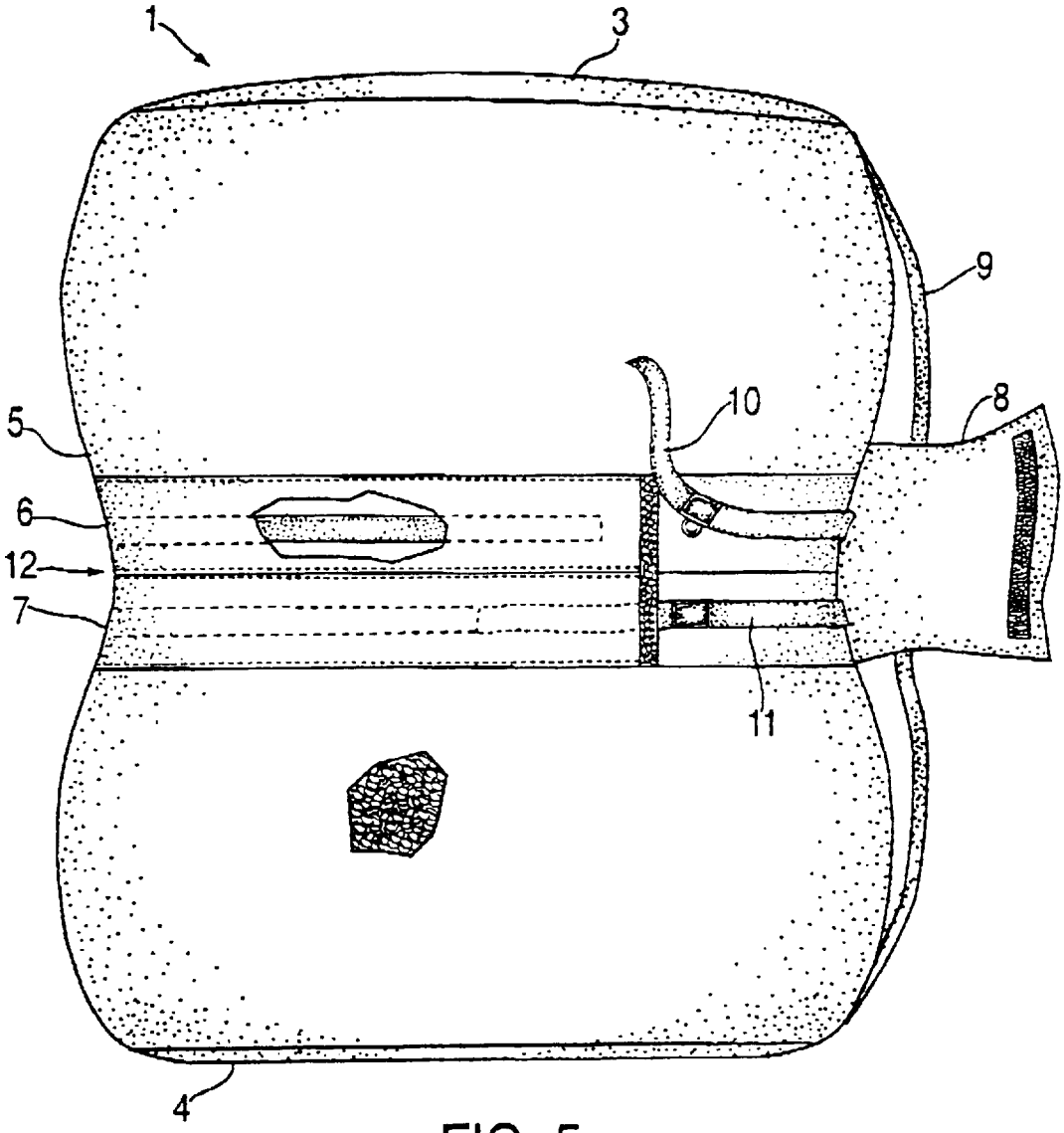
FIG. 5 is a side elevational view and partial cross section of the pillow as in FIG. 2, showing the encircling belts and the interior filling material.

As shown in the drawings, the adjustable pillow 1 uses a flexible twill fabric shaped in a generally cylindrical configuration, wherein an upwardly extending cylindrical wall 5 is connected to generally circular top and bottom base portions 3 and 4. The pillow 1 contains the generally tubular wall portion 5 that separates the base portions 3 and 4. Furthermore, the pillow 1 includes one or more belts 10, 11 in sleeve portions 6, 7 as well as a closeable flap 8 which covers the straps which compress the pillow. The flap helps create a neat appearance. It is held in place by 3 VELCRO® strips which create a "box" to cover and hold the buckles and straps out of sight. Auxiliary carrying handle 9 is also provided. As shown in FIG. 5, each sleeve portion 6, 7 encircles a medial mid portion 12 of adjustable pillow 1. When the belts 10 and 11 are cinched and pulled tight they change the configuration of the generally cylindrical pillow 1 to an hour glass shape, as shown in FIGS. 4 and 5, with a constricted medial portion and an increased height. The flap 8 covers the exposed parts of the belts to keep a smooth continuous surface around the medial portion of the pillow 1.

While the drawing Figures show pillow 1 with sleeves 6, 7 having belts 10, 11 therein, it is further contemplated that a single, separate belt (not shown) may be provided and sold separately to encircle and constrict pillow 1.

Optionally, pillow 1 can be provided with at least one belt (not shown) which is attached at one or more points thereon to pillow 1.

Figure 1:
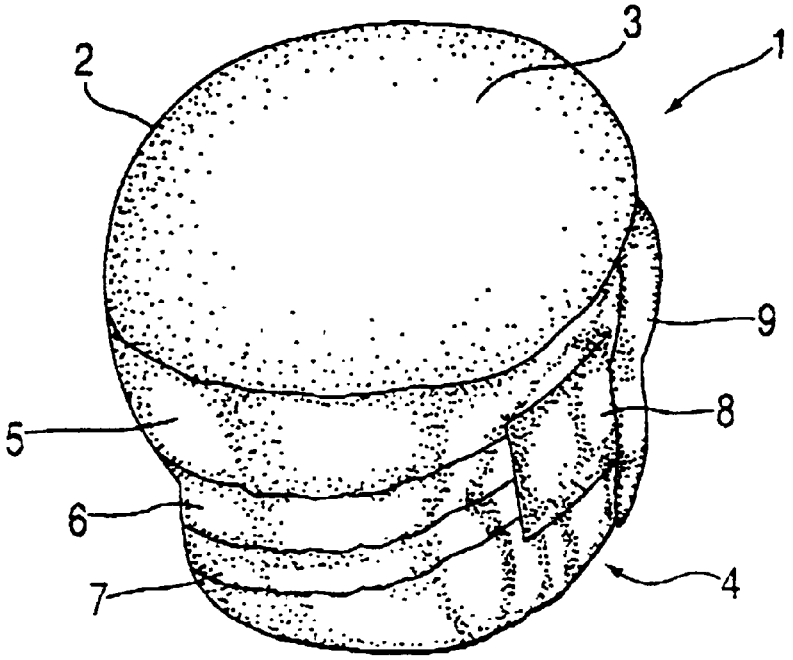
FIG. 1 is a top perspective of the embodiment of the adjustable pillow of the present invention in a constricted configuration.
Figure 2:
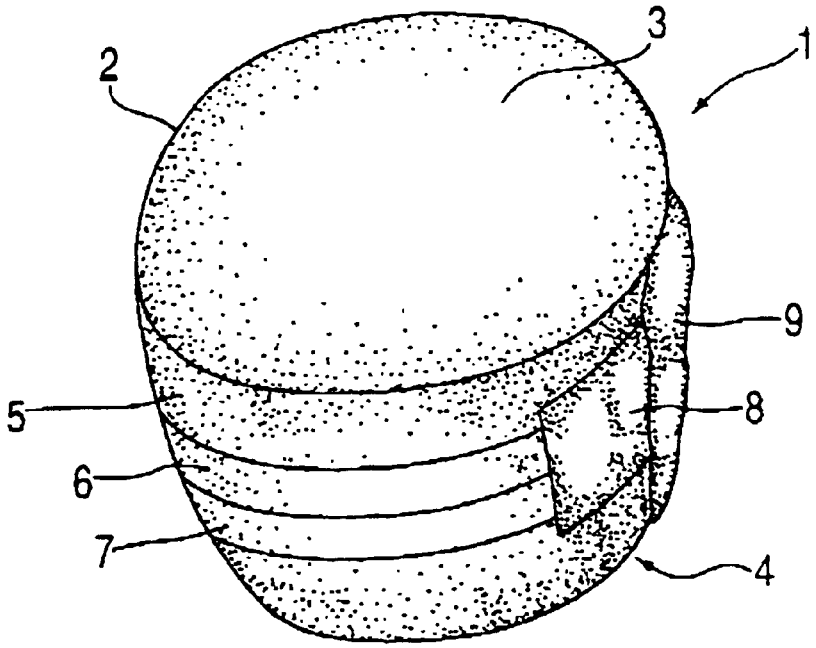
FIG. 2 is a top perspective thereof shown in a normal unconstricted position.
Figure 3:
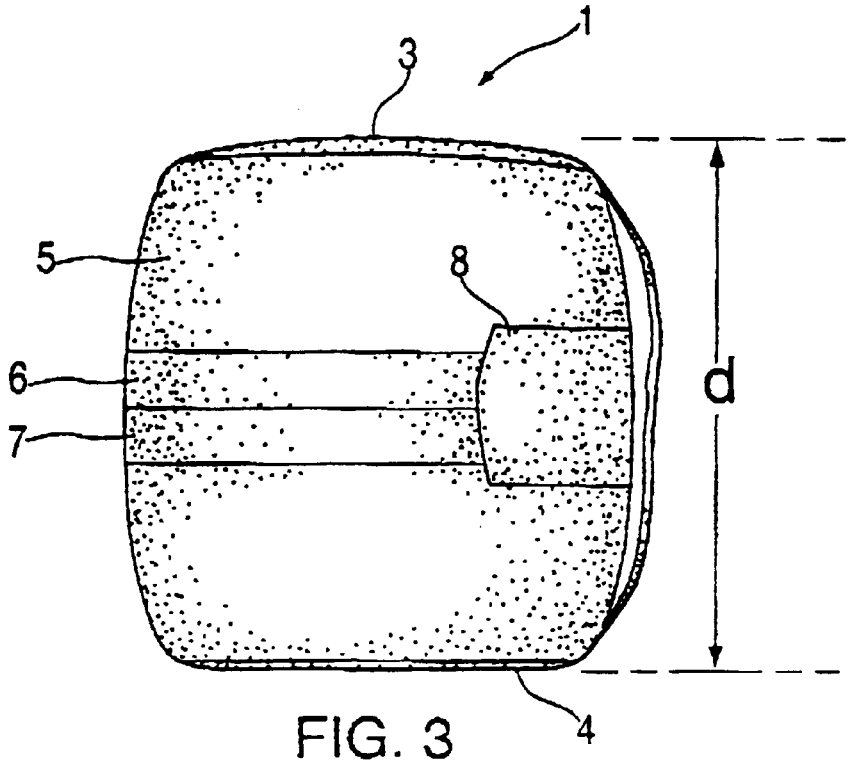
FIG. 3 is a side elevational view of the pillow as in FIG. 1 shown in a relaxed state.

As shown in FIG. 3 in the relaxed position of the pillow 1, dimension 'd' has a height of 8½ inches, although the height may vary, such as, for example from four to fourteen inches in height in the relaxed state. FIG. 3 shows the belts 10, 11 in a relaxed state with the height at about 8½ inches tall.

As shown in FIG. 4, upon constriction of the belts 10 and 11 so that the pillow, when starting from a relaxed height of 8½ inches in height, assumes an hour glass shape, the height "d" is increased to approximately 14 inches. Proportionally similar increases in height occur when the pillow varies in height, depending upon the starting height of the pillow in a relaxed state.

As further shown in FIG. 5, the cutaway view therein shows the type of material, such as buckwheat hulls which give the adjustable pillow its generally firm shape and which permit it to expand and contract.

Figure 5A:
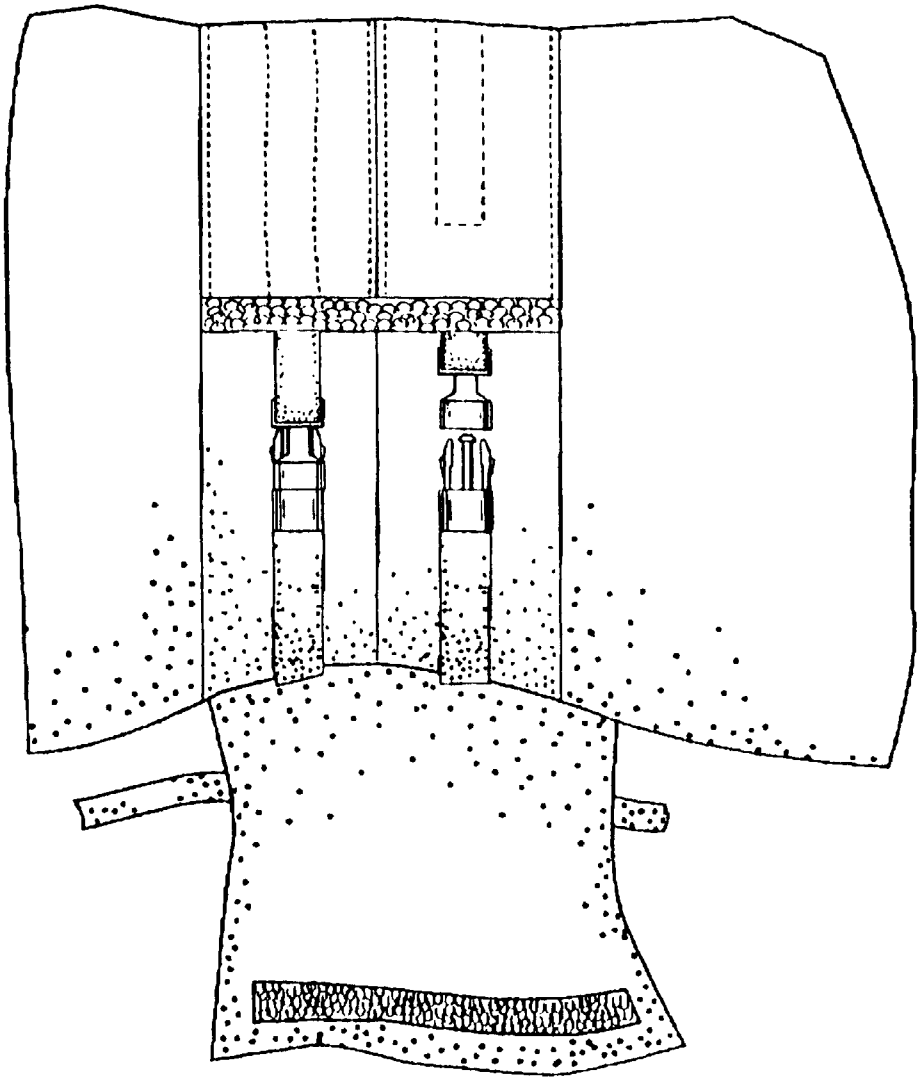
FIG. 5*a* is a side elevational view and partial cross section of another embodiment of a pillow, showing the encircling belts and side release buckles.

In FIG. 5 the belts have snap button fasteners; in the alternate embodiment shown in FIG. 5*a,* the belts have side release snap buckle fasteners. The pillow 1 can also use cam buckles (not shown).

Figure 6:
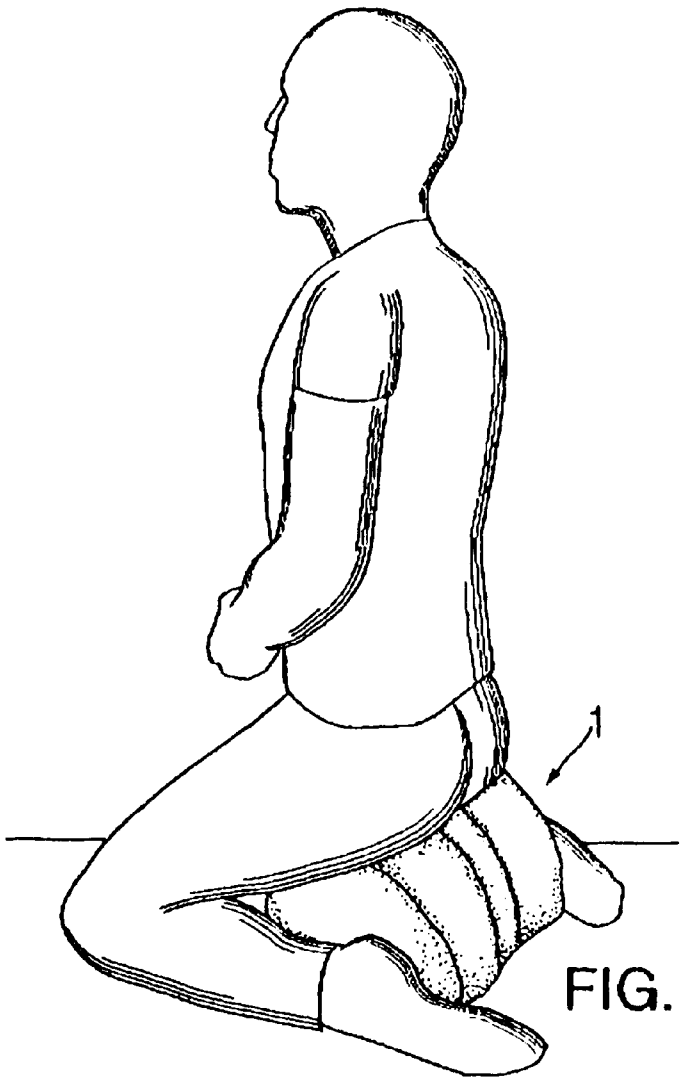
FIG. 6 is a perspective view showing a user using the pillow in a Seiza meditative position; the pillow is shown on its side, in the medial position.

FIG. 6 shows a user using the pillow in an alternate horizontal position where the pillow is laid axially with the top and bottom positioned on the horizontal axis. This position of the pillow can be used for a seiza position as shown or for the lotus or Burmese meditative positions.

Figure 7:
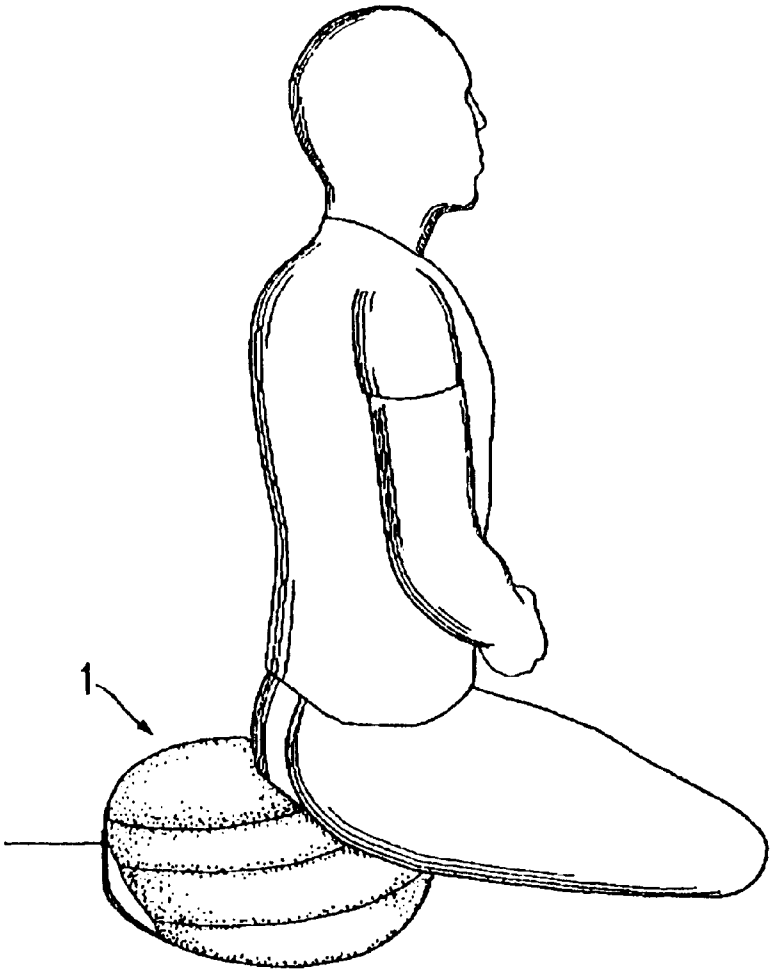
FIG. 7 is a perspective view showing the pillow in an upright position wherein the user is in a modified Lotus meditative position.

FIG. 7 shows the pillow 1 in an upright uncinched cylindrical shape. This shape can be used for either the seiza meditative position or for either a lotus or Burmese sitting position (these are suggested by the drawing.) The user can sit higher or lower on the cushion by shifting the buckwheat hull filler back or forward and thus creating a higher or lower perch. The user can also shift the cushion 1 by manipulating the belts to find various heights, angles and densities that work for him/her.

In the seiza semi- kneeling position, the user can increase the height of the pillow 1 to move his/her lumbar and coccyx regions further from the floor by constricting the belts 10, 11 around the mid portion of the pillow 1. And, of course, the user can lower the height by loosening or unsnapping the belts 10, 11.

It is further noted that the user can alternatively use an auxiliary, non-adjustable cylindrical pillow or "mini-zabuton™" (not shown) approximately 20 inches long and about 7 inches wide, which also uses buckwheat hulls of other fillers. This pillow can be placed under the user's knees to relieve pressure on the knees. It can also be used as a prop under the leg of a user in a Burmese position.

FIG. 7 shows the sitter on the cushion in a lotus or Burmese position. For these positions the height of the pillow can also be shifted up or down.

Figure 8:
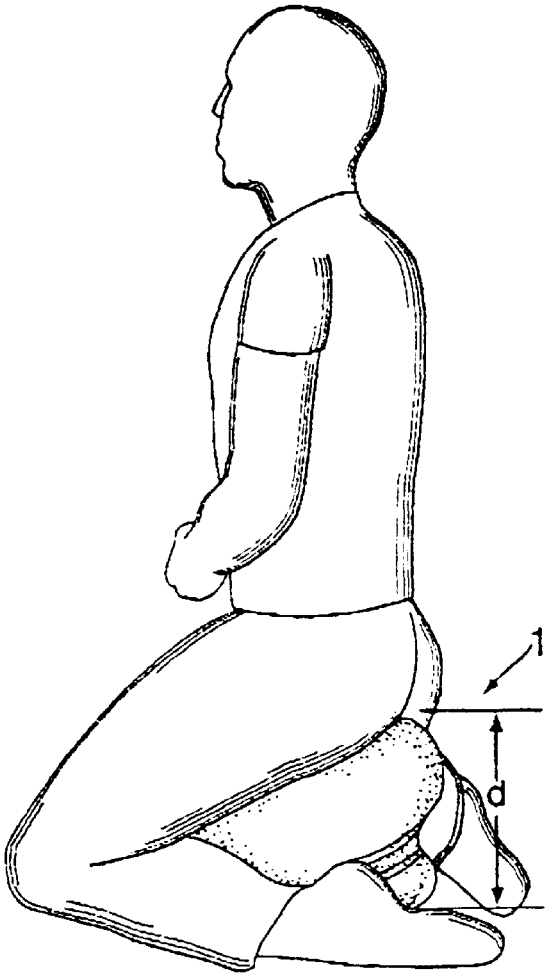
FIG. 8 is a side perspective view of the pillow being used in a semi-kneeling position (Seiza) with the height of the pillow increased by pulling the straps tight.
Figure 9:
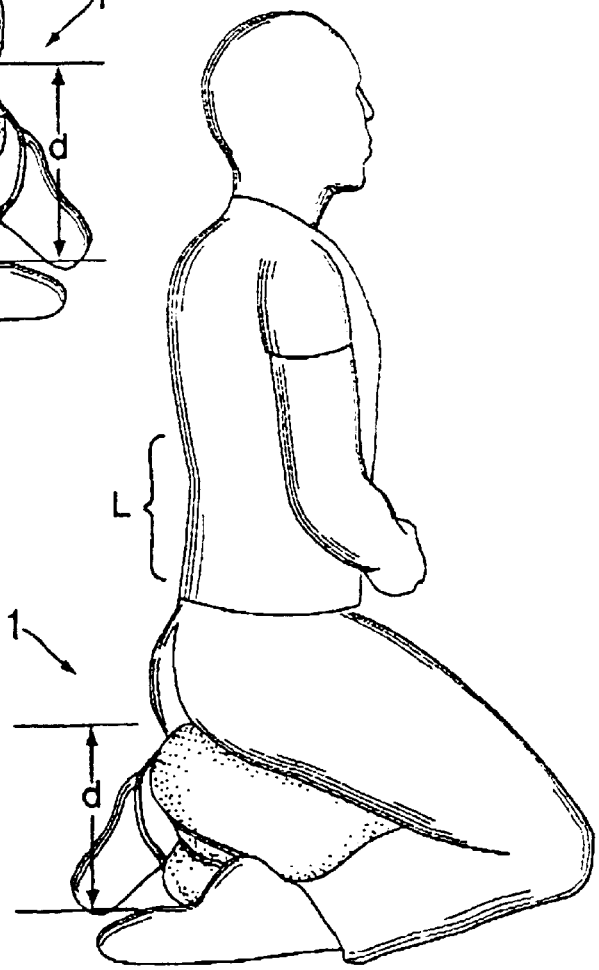
FIG. 9 is a side elevational view showing the pillow in use by someone in a seiza position with the pillow in a somewhat relaxed, lowered position (one strap open)

As shown in FIG. 8 and 9, in the kneeling position the dimension "d" can be adjusted to raise or lower the sitting position. In addition a person can adjust these positions by shifting his or her weight on the cushion and by opening one of the two belts. These adjustments help the sitter achieve a normal lumbar curve of the spine as indicated by reference letter L.

Figure 10A:
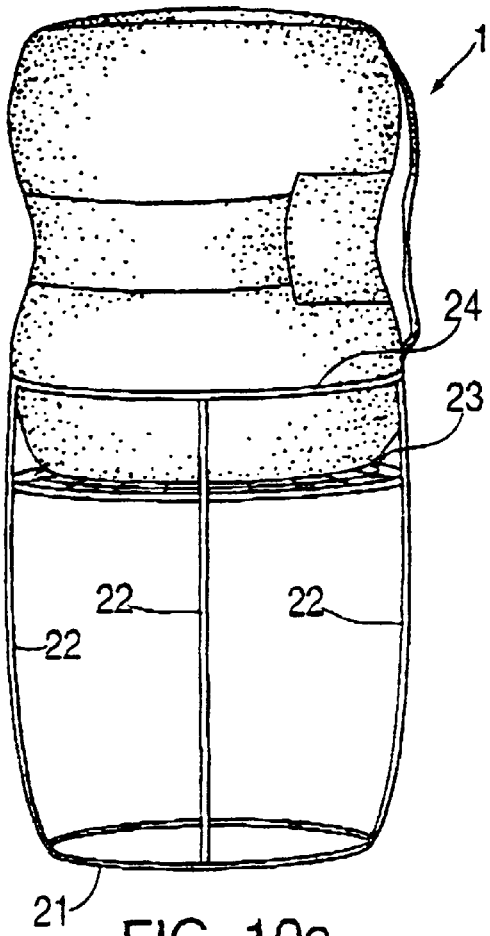
FIG. 10*a* is a front elevational view of a chair with an adjustable height cushion of the present invention.

As shown in FIGS. 10*a,* 10*b* and 11, the adjustable height pillow 1 of the present invention can also be used in conjunction with a backless chair or stool. This combination raises the cushion to normal sitting height and contributes to proper posture and comfort for seated people.

Figure 11:
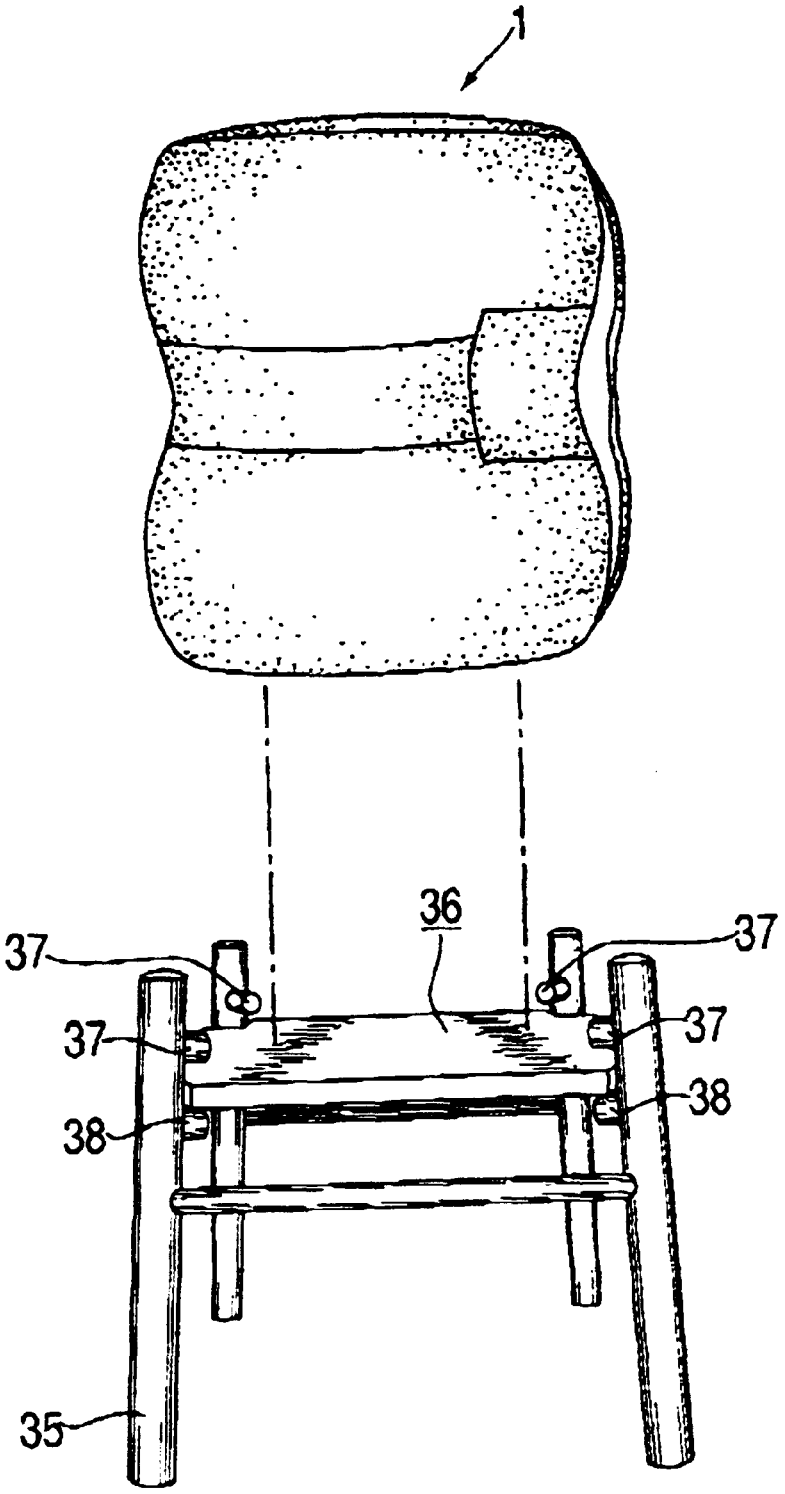

As shown in FIG. 11 the stool like support 36 can be raised to sit on the pegs 37, creating an alternate higher place to rest the adjustable cushion.

In FIG. 10*a* the pillow 1 is supported on a framework which includes a bottom base 21 and upwardly extending supports 22 which hold a flat horizontally oriented base 23 for supporting the adjustable pillow 1.

Figure 10B:
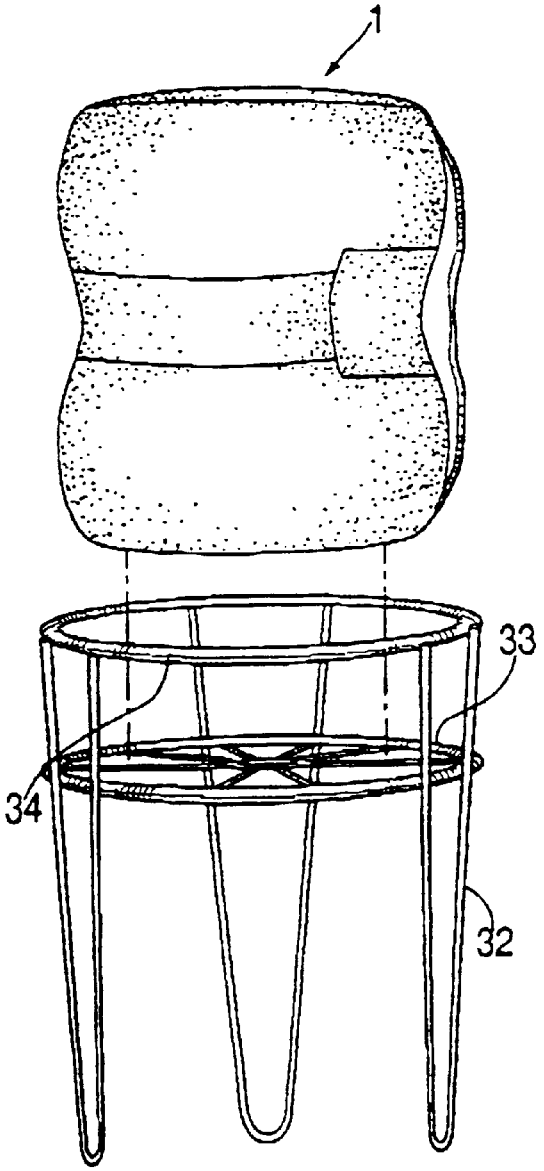
FIG. 10*b* is an exploded side elevational view of another embodiment for a chair and pillow; and, FIG. 11 is a head on view of another embodiment for a stool designed to hold the cushion at one of two heights.

FIG. 10*b* shows another support framework 30 with a bottom base 31 and upwardly extending legs 32 supporting pillow 1 on the platform 33.

Furthermore, an annular upper edge portion 34 is provided to firmly hold the pillow 1 in place upon the support framework. The support platform 33 holds the pillow at a height that enables a person to sit at a normal height or to vary her/his sitting height by adjusting the pillow.

In FIG. 11 there is shown a stool that allows the pillow to rest at one of two heights, either on the supports 38 that run between the four legs or on the higher supports that are pegs 37. The moveable platform 36 is cut so that it may easily be lifted from its position at 38 to its position at 37. Given the adjustability of the cushion, this stool gives the user a larger variety of choices for sitting height, for pillow angle and for firmness.

It is further noted that other modifications may be made in the present invention without departing from the scope of the invention as noted in the appended claims.

I claim:

1. A height adjustable pillow for sitting thereon comprising a generally vertically extending, cylindrical body of a soft flexible material, said cylindrical body having an encircling wall portion separating a top base from a bottom base, said bottom base adapted to rest on a horizontal support, said top base adapted to receive the coccyx of a user, said pillow having inserted therein a plurality of filler members providing a firm support, said pillow having at least one encircling belt for cinching and constricting a medial mid portion of said pillow, thereby causing said filling materials to constrict in the middle and expand at top and bottom thus increasing the height of said pillow, and means comprising a sleeve surrounding and incorporated into said cylindrical body to contain said cinching belt and a flap enclosing exposed ends of said belt to fully contain said belt and said exposed ends of said belt when said pillow is in use.

2. The pillow as in claim 1 wherein said filler material for said pillow comprises a fabric.

3. The pillow as in claim 2 wherein said filler material for said pillow comprises a cotton/polyester twill.

4. The pillow as in claim 1 wherein said at least one belt comprises a plurality of belts at said medial mid portion of said pillow.

5. The adjustable height pillow as in claim 1 wherein at least one belt is provided within at least one sleeve encircling said medial mid portion of said pillow.

6. The adjustable height pillow as in claim 1 wherein said at least one belt is separate from said pillow.

7. The adjustable height pillow as in claim 1 wherein said at least one belt is attached at one or more points thereon to said pillow.

8. The height adjustable pillow as in claim 1, wherein said at least one encircling belt is loosened and tightened by a buckle.

9. The height adjustable pillow as in claim 8, wherein said buckle is a snap buckle.

10. The height adjustable pillow as in claim 8, wherein said buckle is a side release buckle.

11. The height adjustable pillow as in claim 8, wherein said buckle is a cam buckle.

12. The adjustable height pillow as in claim 1 wherein said pillow further comprises an auxiliary handle.

13. The adjustable height pillow as in claim 1 wherein said filler comprises buckwheat hulls.

14. The adjustable height pillow, as in claim 1 wherein said filler comprises bead like members.

15. The adjustable height pillow as in claim 1 wherein said pillow is from four to fourteen inches in height in a relaxed state.

16. The adjustable height pillow as in claim 15 wherein said pillow is about 8½ inches in height in a relaxed state.

17. An adjustable height chair comprising said pillow as in claim 1 and an upwardly extending base for supporting said bottom base of said pillow in an elevated position for use by a user seated at a desk or a table.

18. The method of using a cushioned seat comprising the steps of:

a) placing on a horizontal platform a cushioned seat, said cushioned seat comprising a vertically extending cylindrical body of soft material containing filling material, a bottom base closing a bottom opening of said cylindrical body resting on said horizontal platform, a top base closing a top opening of said cylindrical body, and means comprising an annular sleeve in a medial mid portion of said cylindrical body for containing a cinching strap adapted to constrict said cylindrical body to adjust the height of said seat, said sleeve having openings for access to loose ends of said strap, and a flap for enclosing said openings when said seat is in use;

b) opening said flap and adjusting the height of said seat by changing the tension in said cinching belt;

c) closing said flap after said cinching belt is adjusted to bring the height of said pillow to the desired value, the loose ends of said strap being fully contained during normal use of said pillow; and d) sitting on said top base of said seat.

19. The method of sitting as recited in claim 18 having a pair of sleeves adjacent to each other for accommodating cinching straps, said flap enclosing openings in both of said annular sleeves so that loose ends of both of said straps are fully enclosed by said flap during normal use of said seat.

* * * * *